US005934526A

United States Patent [19]

Rosenbaum et al.

[11] Patent Number: 5,934,526

[45] **Date of Patent: *Aug. 10, 1999**

[54] DEVICE FOR FACILITATING MANIPULATION OF JEWELRY CLASPS

[76] Inventors: Richard L. Rosenbaum; Virginia L. Rosenbaum, both of 12396 World Trade Dr., Suite 215, San Diego, Calif. 92128

[ * ] Notice: This patent issued on a continued prosecution application filed under 37 CFR 1.53(d), and is subject to the twenty year patent term provisions of 35 U.S.C. 154(a)(2).

[21] Appl. No.: 08/851,202

[22] Filed: May 5, 1997

[51] Int. Cl.[6] ..... A47G 25/80

[52] U.S. Cl. ..... 223/111; 223/DIG. 2; 24/521

[58] Field of Search ..... 223/111, DIG. 2; 24/521, 322, 449

[56] References Cited

U.S. PATENT DOCUMENTS

| | | | |
|---|---|---|---|
| D. 323,132 | 1/1992 | Grennan . | |
| D. 363,042 | 10/1995 | Papernik et al. . | |
| 537,557 | 4/1895 | Varney | 24/521 |
| 691,364 | 1/1902 | Dencla . | |
| 745,990 | 12/1903 | Baker | 24/521 |
| 1,987,987 | 1/1935 | Bohmbach | 24/521 |
| 3,016,589 | 1/1962 | Collins . | |
| 4,130,226 | 12/1978 | Farrell | 223/111 |
| 4,779,312 | 10/1988 | Carlson . | |
| 5,405,066 | 4/1995 | Fakier . | |
| 5,671,515 | 9/1997 | Evans | 24/615 |

OTHER PUBLICATIONS

Miles Kimball Catolog (1994), p. 57, "Jewelry Clasp".

*Primary Examiner*—Bibhu Mohanty
*Attorney, Agent, or Firm*—Thomas J. Tighe

[57] ABSTRACT

In the preferred embodiment, opposing jaws are biased closed for grasping the clasp of a string type bracelet. Prior to grasping, as the clasp is being inserted between the jaws, a post or boss asserts a reactive force against an operating lever of the clasp causing the clasp to open. While the clasp is held open, the jaws are released to grasp the clasp and keep it open. Preferably the jaws are affixed to a wrist band which when wrapped around a user's wrist holds the grasped clasp in a position to loop the bracelet around the wrist and hook an eyelet at the opposite end of the bracelet onto the clasp. When the jaws are opened to release the clasp, the clasp closes capturing the eyelet. The wrist band is then removed leaving only the bracelet around the wrist. The clip can also be used to hold earring clasps for easy placement on earring studs, and for other kinds of jewelry.

9 Claims, 2 Drawing Sheets

DEVICE FOR FACILITATING MANIPULATION OF JEWELRY CLASPS

BACKGROUND OF THE INVENTION

This invention relates in general to devices that grasp jewelry clasps and hold them open for fastening, and in particular, to such devices that are designed to work with latching type clasps having an operating lever.

Since their inception, latching type clasps for string type bracelets have been difficult to manipulate by a wearer alone, especially the clasps with spring biased latches. Coupling the ends of a string bracelet requires a great deal of coordination and dexterity in the one-handed manipulation of the bracelet's clasp. Trying to hold the clasp open while at the same time, and with the same hand, maneuvering the loop into the clasp can be frustrating and aggravating. For many with arthritis, it is impossible. This invention facilitates the fastening and unfastening of such clasps so that they can easily and quickly be coupled and uncoupled, even by persons suffering from arthritis.

This invention can also be used for clasps of other kinds of jewelry. For example, it can be used to grasp the clasp of an earring to aid in placing the clasp in position over the earring post to secure it.

Other advantages and attributes of this invention will be readily discernable upon a reading of the text hereinafter.

SUMMARY OF THE INVENTION

An object of this invention is to provide a tool to assist in the fastening and unfastening of jewelry clasps.

A further object of this invention is to provide a tool for facilitating the coupling and uncoupling of clasps of string-type bracelets.

An additional object of this invention is to provide a tool for holding the clasp latch of a bracelet open, in position on the wearer's wrist, freeing the wearer's other hand to insert the bracelet's eyelet into the held-open latch.

An additional object of this invention is to provide such a tool which does not mar or otherwise damage the jewelry on which it is used.

An additional object of this invention is to provide a device to aid in the coupling of earring and necklace clasps.

These objects, and other objects expressed or implied in this document, are accomplished by an apparatus for use in the coupling of a jewelry clasp including: a part that grasps the clasp, for example an alligator-type clip with opposing jaws for clamping onto a clasp; means for coupling the clip to a user's hand to hold the grasped clasp in a position for coupling; and a catch projecting from the clip for asserting a reactive force against an operating lever of the clasp causing it to open as the clasp is being inserted into the jaws, the clasp remaining open until it is released from the jaws. The means for coupling is preferably an elastic wrist band but can be simply a loop for hooking one or more fingers. A modified common alligator clip can be used. The clip is modified by grinding off the teeth of the jaws to prevent damage to articles of jewelry, filling the jaws with an epoxy material to increase the holding area, and coating the jaws with a rubber or rubber-like material to increase friction for holding jewelry clasps. A post is inserted in the lower jaw of the clip to catch the operating lever of a clasp to hold it open while the entire clasp is held by the jaws. The user can then simply hook the loop of the other end of the article of jewelry in the open clasp and release the clip, leaving the article of jewelry fastened to the wearer.

DESCRIPTION OF THE PREFERRED EMBODIMENT

Figure 1:
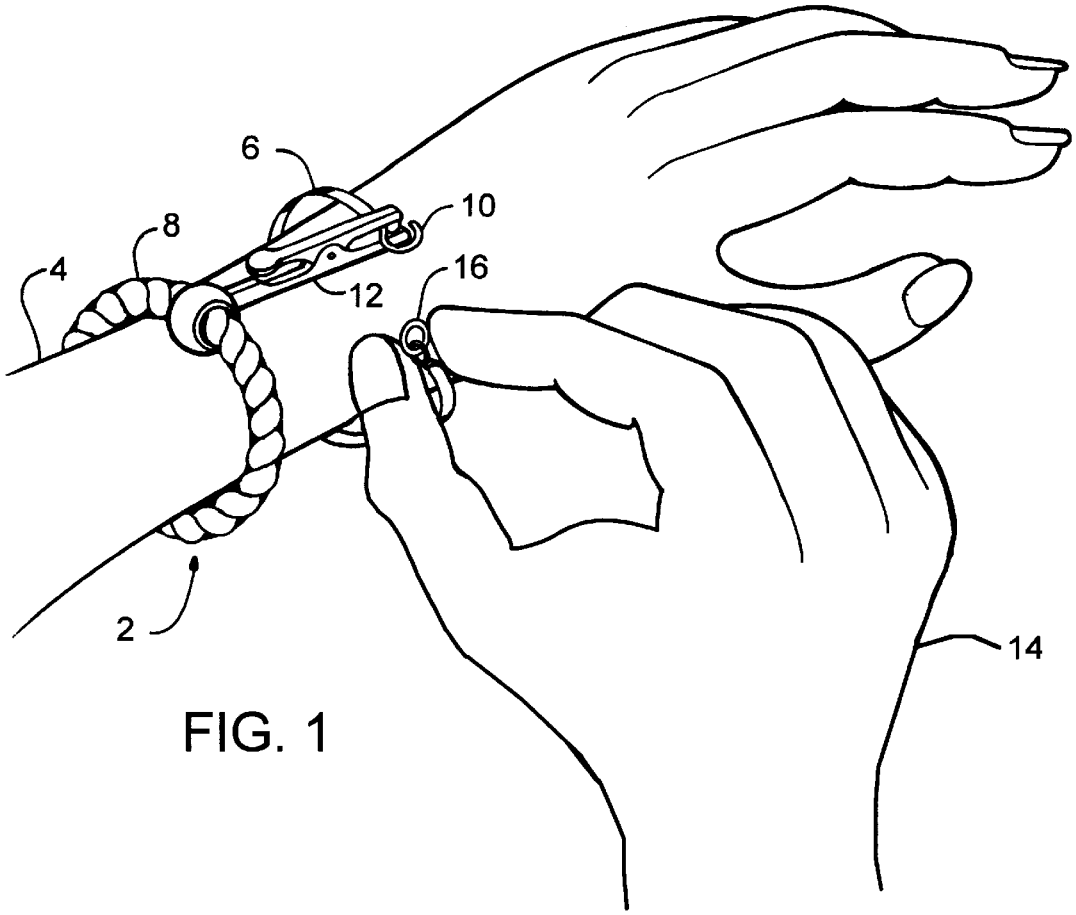
FIG. 1 is a pictorial view of the invention in use on a wearer's wrist holding a bracelet clasp open and thereby allowing the wearer to close the bracelet easily.

Referring to FIG. 1, this invention, generally designated 2, is shown in position on a wrist 4 of a person who is using it to assist in fastening a bracelet 6. A resilient strap 8 encircles the wrist, and a clasp 10 is held open by an alligator clip 12, allowing the person to use his or her free hand 14 to hook an eyelet 16 into the opened clasp.

Figure 2:
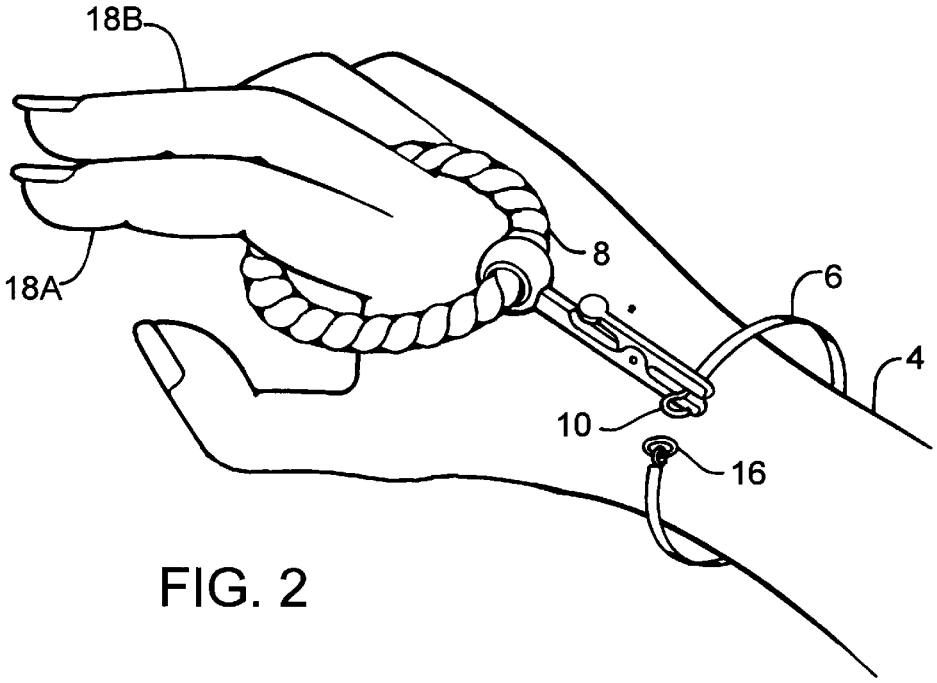
FIG. 2 is a pictorial view of the invention showing an alternate way to use it, i.e. looped over the fingers of a wearer.

Referring to FIG. 2, the invention is alternatively held in place near a person's wrist 4 by the resilient strap 8 encircling two of the person's fingers 18A and 18B. A clasp 10 is being held open by the alligator clip and the person may use his or her free hand to hook the eyelet 16 into the opened clasp.

Figure 3:
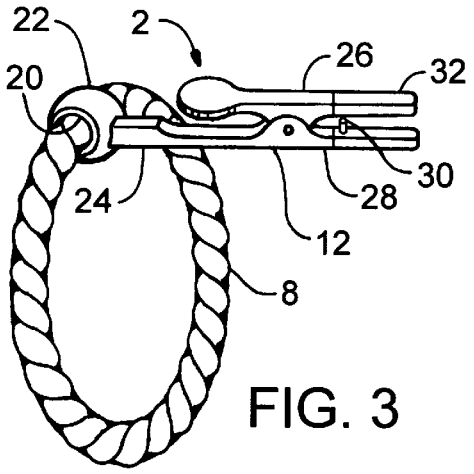
FIG. 3 is a pictorial view of this invention with the jaws held slightly open to illustrate a latch lever catching post.

Referring to FIG. 3, a more detailed view of the invention is shown wherein the elastic strap 8 runs through a slip coupling, which is illustrated here to be a bead 22 having a central through-hole 20. A stem 24 of the alligator clip 12 is radially affixed to the bead, the stem being secured in a radial hole defined by the bead. The alligator clip is shown with an upper jaw 26 in an open position. In the lower jaw 28, a post 30 projects normally therefrom toward the upper jaw. The post is at or near the inner ends of the jaws. Preferably a rubber or rubber-like coating (not shown) covers the jaws to prevent marring or otherwise damaging the clasps.

Figure 4A:
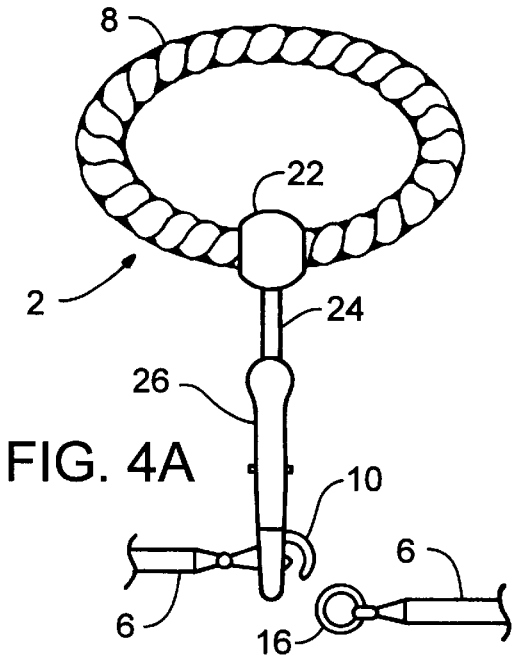
FIG. 4A is a plan view of the invention holding a bracelet clasp open to receive the eyelet at the other end of the bracelet.
Figure 4B:
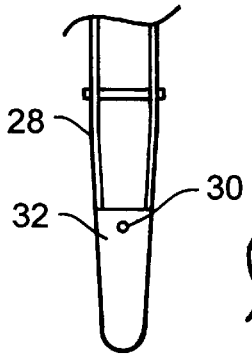
FIG. 4B is a plan view of the jaw with the clasp lever-catching post.

Referring to FIGS. 3 and 4A, the wrist band 8 is an elastic band preferably covered with a fabric material. A plurality of beads may also be strung on the band for decorative purposes. During manufacturing, the band is inserted through the hole 20 in the bead 22 and then tied with the knot being positioned inside the bead. The bead is preferably a decorative plastic bead, but it could also be made of wood, metal or other suitable material. A stem 24 of the alligator clip is inserted in a correspondingly sized radial hole in the wall of the bead and secured by an adhesive. Preferably the stem hole is through the wall and the stem projects into the band hole to aid in keeping the band knot in the bead. The alligator clip can be specially made, or commonly available metal alligator clips can be modified for use in this invention. In modifying a common alligator clip, the teeth of the clip are ground off; and a forward portion of a lower jaw is filled with a metallized epoxy 34, as shown in FIG. 4B. This epoxy is ground smooth and a central hole is drilled through the epoxy and the lower jaw. A post 30 is inserted in the hole. A portion of the upper jaw, forward of the post, is also filled with metallized epoxy, and is ground smooth. The upper jaw's epoxy must stop short of the lower jaw's post so that the post can extend into the unfilled portion of the upper jaw when the alligator clip is closed. The post is affixed in place by dipping the filled portions of the jaws in an epoxy resin enamel. The enamel also adds decorative color and a smooth surface to the jaws. After the epoxy enamel has cured, a thermoplastic rubber coating is applied to the jaws, up to the post, by dipping them in a material such as Plasti-Dip, described in U.S. Pat. No. 4,536,454. This creates a rubbery coating 32 to increase the friction coefficient of the jaws to enhance their ability to hold a clasp.

Figure 4C:
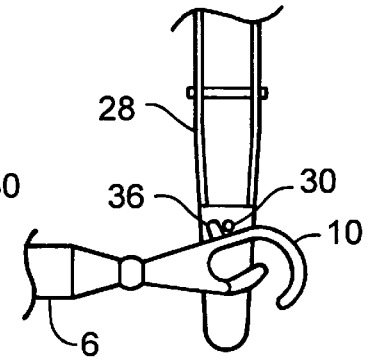
FIG. 4C is a plan view of the jaw with the post showing the clasp of a bracelet being held open.
Figure 4D:
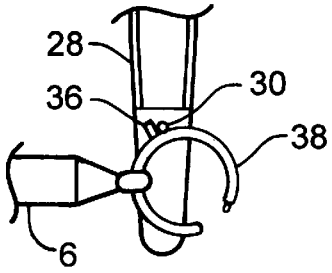
FIG. 4D is a plan view of the jaw with the post showing a ring type clasp being held open.

Referring to FIGS. 4C and 4D, in operation, the clasp 10 of an article of jewelry, such as a bracelet 6, is inserted between the jaws that are held open As it is being inserted, the operating lever 36 of the clasp is caught by the post 30 which asserts a reactive force against the lever causing the lever to move back thereby opening the clasp. The jaws are then released and allowed to close on the clasp to hold it open. The wearer's wrist on which the bracelet is to be placed is then inserted through the elastic band 8 as shown in FIG. 1, or over the wearer's fingers as shown in FIG. 2. With the bracelet held by the alligator clip, the wearer can then use his or her free hand to grasp the eyelet 16 at the free end of the bracelet, wrap the bracelet around the wrist, and hook the eyelet onto the open clasp. The jaws are then opened, allowing the clasp to close, thus fastening the bracelet. The wrist band is then removed from the person's wrist leaving the bracelet. The same procedure can be followed for other types of clasps such as the spring-biased ring clasp 38 as shown in FIG. 4D.

Figure 5:
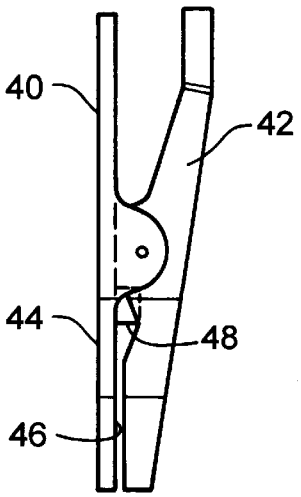
FIG. 5 is an elevation view of a second embodiment.
Figure 6:
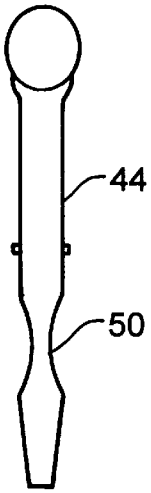
FIG. 6A is a top view of the second embodiment.
Figure 7:
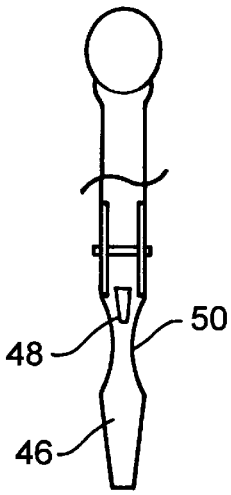
FIG. 7 is a cut-away view of the second embodiment with the jaw without the post removed.

Referring to FIGS. 5–7, a second embodiment of the alligator clip of this invention can be specially made, e.g. from plastic by injection molding. Such an alligator clip 40 would include an upper jaw 42 and a lower jaw 44 each having a flat frictional gripping surface 46. The post (30 in FIG. 3) is replaced by an integral wedge shaped boss 48 which performs the same function. Preferably the jaws would also have a narrow, reduced width section 50 in front of the boss to accommodate smaller clasps, as they would more readily protrude beyond the side of the jaws in the open position.

A metal alligator clip may also be manufactured without any teeth in the jaws, a smooth flat grasping surface in both the upper and lower jaws and a pin inserted in the lower jaw.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims. For example, the latch lever catching posts (30 of FIGS. 3 and 4B–C, and 48 of FIGS. 5 and 7) have been illustrated as a cylindrical post and a wedge-shaped boss, but the post can be of any shape or form sufficient to catch the latch lever. It may even be a projection from a margin of a jaw. Moreover it can be added after the jaws are made or it can be molded or otherwise made as an integral part of a jaw.

We claim:

1. A jewelry clasp coupling apparatus comprising:

(a) a biased jaw means for grasping the clasp, the jaw means having an upper jaw and a lower jaw, the jaws being forced open by a user to insert the clasp therein, the jaws being released to grasp the clasp;

(b) means for coupling the jaw means to a hand and for holding the grasped clasp in a position for coupling; and (c) a post means affixed between the upper and lower jaws wherein the post provides a reactive force against an operating lever of the jewelry clasp as the clasp is inserted into the open jaws, the post means keeping the clasp open until the jaw means is forced open again and the post means is moved away from the operating lever.

2. The apparatus according to claim 1 wherein the post means for asserting the reactive force comprises a projection disposed between the jaws means.

3. The apparatus according to claim 2 wherein the projection is a cylindrical post disposed in a mouth of the jaw means.

4. The apparatus according to claim 1 wherein the means for coupling comprises a wrist band to which the jaw means is affixed.

5. The apparatus according to claim 4 wherein the wrist band is an elastic band.

6. The apparatus according to claim 1 wherein the means for coupling comprises means for hooking one or more fingers of a user, the jaw means being affixed to the means for hooking.

7. The apparatus according to claim 1 wherein the jaws means are coated with a substance to increase their frictional coefficient.

8. The apparatus according to claim 1 wherein the jaws means comprises a pair of opposing jaws each including a flat frictional surface for grasping a clasp.

9. The apparatus according to claim 8 wherein the opposing jaws are coated with a substance to increase their frictional coefficient.

* * * * *